United States Patent [19]

Berardi

[11] Patent Number: 4,507,873

[45] Date of Patent: Apr. 2, 1985

[54] APPARATUS FOR ACCURATELY ESTABLISHING THE SEALING LENGTH OF CRT ENVELOPES

[75] Inventor: Randal L. Berardi, Lancaster, Pa.

[73] Assignee: RCA Corporation, New York, N.Y.

[21] Appl. No.: 560,391

[22] Filed: Dec. 12, 1983

[51] Int. Cl.[3] ..... H01J 9/18

[52] U.S. Cl. ..... 33/180 R; 445/45

[58] Field of Search ..... 33/180 R; 445/45, 63, 445/64, 67, 34, 4

[56] References Cited

U.S. PATENT DOCUMENTS 3,962,764 6/1976 Stewart et al. ..... 29/25.13
3,962,765 6/1976 Stachel et al. ..... 29/25.13
4,445,874 5/1984 D'Augustine et al. ..... 445/45

FOREIGN PATENT DOCUMENTS 0108145 8/1980 Japan ..... 445/45
0041646 4/1981 Japan ..... 445/64

*Primary Examiner*—Harry N. Haroian
*Attorney, Agent, or Firm*—Eugene M. Whitacre; Dennis H. Irlbeck; Lester L. Hallacher

[57] ABSTRACT

A support for establishing the sealing length of kinescopes includes a pivotable support. The support is contoured to conform with a contoured neck area of the kinescope whereby the contour references the envelope to a seal plane.

4 Claims, 3 Drawing Figures

APPARATUS FOR ACCURATELY ESTABLISHING THE SEALING LENGTH OF CRT ENVELOPES

BACKGROUND OF THE INVENTION

This invention relates generally to the production of cathode ray tubes (CRT) and particularly to an apparatus for establishing the sealing length of the envelopes of such tubes.

A CRT for a color television set includes a glass funnel the wide end of which is closed off with a faceplate panel. The narrow end of the funnel curves through a contoured neck area into a cylindrical portion to which a cylindrical neck is attached. A phosphor screen, comprised of triads of different color emitting phosphors, is placed upon the inside surface of the faceplate panel. An electron gun is accurately positioned in the neck portion to generate three electron beams. The electron beams are attracted to the screen and impact the phosphors resulting the emission of a different color of light by each of the three phosphors. A visual picture is generated across the face of the screen by scanning the electron beams horizontally and vertically across the phosphor screen. The scanning is affected using a yoke which is accurately positioned on the contoured neck area of the funnel. The yoke is internally configured to conform to the contour of the contoured neck area of the envelope. The yoke magnetically deflects the electron beams horizontally and vertically to can the phosphor screen. Arranged between the electron gun and the screen is an apertured shadow mask through which the electron beams must pass. This shadow mask serves as a color selection electrode to cause each of the three electron beams to impact a phosphor of the proper color. The electron beams, therefore, are converged to cross at the shadow mask.

The convergence of the electron beams at the shadow mask, the coma, the yoke pull back and the electron beam focusing are determined by the distance of the yoke from the screen and also by the distance between the yoke and the electron gun. For this reason, a reference plane is established at a cross section of the contoured neck area where the yoke is positioned. This reference plane is normal to the longitudinal axis of the envelope and is used as a reference to measure the length of the neck. In the art this length is identified as the sealing length. The sealing length extends from the reference plane to the line on the cylindrical neck where the neck is cut off and sealed after the envelope is evacuated. The longitudinal position of the electron gun in the cylindrical neck also is referenced from the reference plane of the curved contoured neck area.

Establishing the sealing length of CRT's using a cross-sectional plane of the contoured neck area of the envelope as a reference position is known in the art. However, difficulties frequently arise because the dimensions of the envelope, and particularly those of the contoured neck area vary within allowable tolerances. For this reason, any equipment which relies on a single envelope dimensional to establish the reference plane is subject to undesirable sealing length variations because of the permissible dimensional tolerances of the envelopes.

The present invention overcomes this difficulty by the provision of an apparatus which utilizes the entire contoured neck area for establishing the reference plane from which the CRT sealing length is measured.

SUMMARY

Apparatus for accurately establishing a preselected sealing length between a sealing plane and reference plane within a contoured neck area of a funnel-shaped envelope includes a support member having an internal contour configured to conform with and extend coextensive with the contoured neck area. The internal contour engages a major portion of the contoured neck area. The support member has an external convex bearing surface in the proximity of the neck area. A base defines the reference plane which is spaced the preselected sealing length from the sealing plane. The base means includes a concave bearing surface in the proximity of the reference plane. The concave and convex bearing surfaces are configured to engage and pivotably retain the support member the preselected sealing length from the sealing plane.

DETAILED DESCRIPTION

Figure 1:
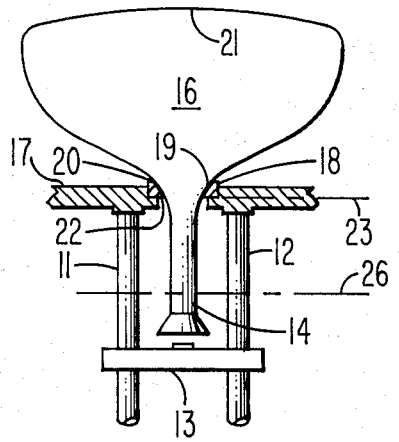
Fig. 1 PRIOR ART
FIG. 1 is a simplified showing of the pertinent parts of a prior art mount sealing machine.

FIG. 1 shows in simplified form how prior art devices such as those described in U.S. Pat. Nos. 3,962,764 and 3,962,765 establish the seal length of CRT envelopes. Two vertical support rods 11 and 12 support a gun mount mechanism 13 which is used to insert an electron gun into the cylindrical neck 14 of a CRT envelope 16. The support rods 11 and 12 support a baseplate 17 which is machined to receive a ring 18 having a contoured beveled aperture 20. The ring 18 is positioned in the plate 17 such that the diameter of the aperture which is closest to the gun mount 13 is smaller than the diameter of the aperture which faces the funnel 16. The CRT envelope 16 includes a contoured neck area 19. The contoured neck area 19 supports the deflection yoke which scans the electron beams across the faceplate 21 of the envelope 16. Accordingly, the contoured neck area 19 is configured and dimensioned as precisely as possible. The diameter of a cross section in the contoured neck area is selected as the reference dimension in establishing the seal length of the envelope. In the art, this diameter is called the seal line. The beveled aperture 20 in the ring 19 is dimensioned so that the smallest diameter, that which faces the gun mount 13, is equal to the precise design diameter of the seal line. Accordingly, the bottom surface 22 of the ring 18 serves as the reference plane 23 for establishing the sealing length of the envelope. Spaced from the reference plane 23 is a sealing plane 26 so that the distance between the reference plane 23 and the sealing plane 26 establishes the preselected sealing length of the kinescope.

The gun mount assembly 13 is used to insert the electron gun into the neck 14 of the envelope 16 and the neck 14 is then cut off along the sealing plane 26. The position of the electron gun with respect to the longitudinal axis of the envelope is important to the operation of the kinescope. Accordingly, this position also is referenced from the reference plane 23.

The contoured neck area 19 of the envelope 16, as well as the other portions of the envelope 16 are molded to known dimensional tolerances. Accordingly, the cross-sectional diameter of the neck area at any particular longitudinal position is not exactly the same for all envelopes. However, the diameter of the aperture 20 in the ring 18 is permanent and, therefore, the longitudinal position at which the aperture 20 engages the contoured neck area 19 will vary longitudinally in accordance with the allowable tolerances of the contoured neck area 19. The position of the seal line, therefore, also varies with respect to the longitudinal axis of the envelope in accordance with the tolerances of the envelope.

Figure 3:
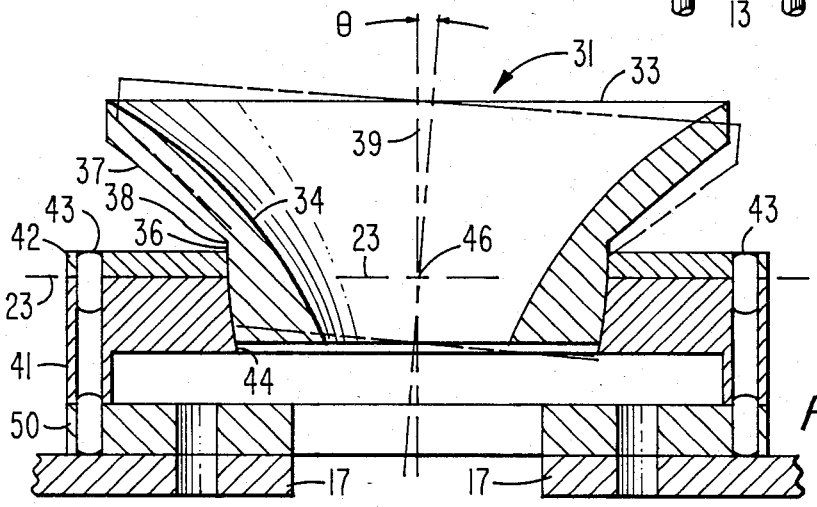
FIG. 3 is a top view of the embodiment of FIG. 2.
Figure 2:
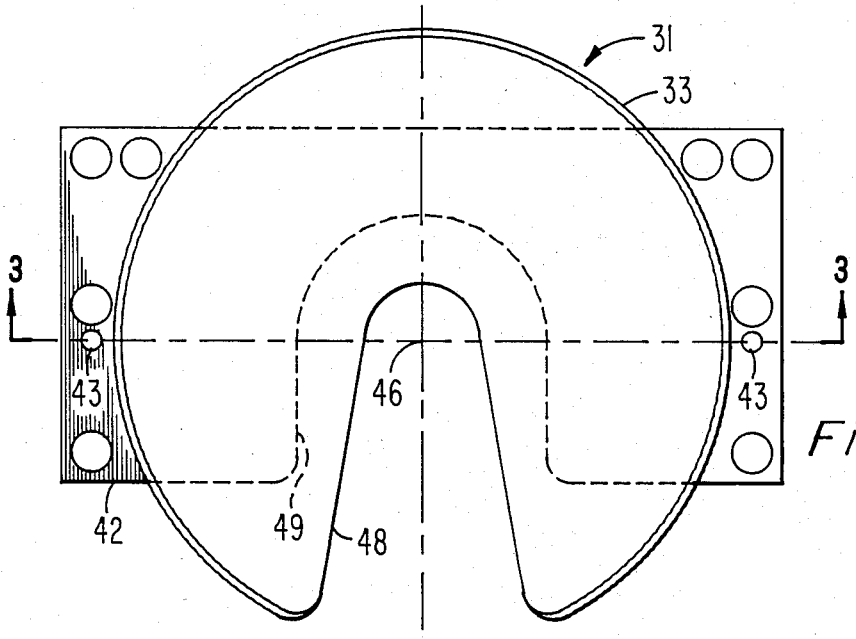
FIG. 2 is a cross-sectional view of a preferred embodiment.

FIGS. 2 and 3 are a preferred embodiment in which the entire contoured neck area 19 of the envelope 16 is used to position the envelope with respect to the reference plane 23. The tolerance variations of the contoured neck area 19 as a whole are much less than the variation of the diameter along an individual cross section. Also the positioning of the deflection yoke on the envelope is determined by the contoured neck area 19. Accordingly, the influence of tolerances in the contoured neck area will tend to have a similar affect on the sealing length and the yoke position, and thereby decrease the effect of the tolerances on the operation of the CRT. For these reasons, the envelope 16 can be substantially more accurately positioned longitudinally by utilizing the entire contoured neck area as a reference rather than the cross-sectional diameter at any particular position along the contoured neck area. Thus, the apparatus 31 of FIGS. 2 and 3 replaces the ring 18 and beveled aperture 20 of FIG. 1.

The apparatus 31 is coupled to the plate 17 by any convenient means and preferably is capable of slight movement in the horizontal plane. The support rods 11 and 12 of FIG. 1 are omitted in FIG. 2 for simplicity. The inventive device 31 includes a support member 33 having an internal contour 34 which is shaped as precisely as possible the same as the contoured neck area 19 of the envelope 16 and which is dimensioned as precisely as possible to the desired dimensions of the contoured neck area 19. The external surface of the support member 33 includes a convex bearing surface 36. A flared portion 37 flares outwardly away from the convex bearing surface 36 whereby the surfaces 36 and 37 meet at a pivot limiting juncture 38. The contour 34, the bearing surface 36 and the flared portion 37 are circular and coaxial about the longitudinal axis 39 of the support member 33. A lower bearing plate 41 is affixed to a retainer member 50. An upper bearing plate 42 is fixed to the lower bearing plate 41 by interference pins 43. The retainer member 50 is coupled to the base member 17 by any convenient means. The reference plane 23 (FIG. 1) is defined by the contiguous surfaces of the bearing plates 41 and 42. The preselected sealing length is thus permanently established for all envelopes between the reference plane 23 and the sealing plane 26.

The bearing plates 41 and 42 together contain a continuous concave bearing surface 44 which is configured the mate with the convex bearing surface 36 of the support member 33. The bearing surface 44 also is coaxial about the longitudinal axis 39. Accordingly, the longitudinal axis 39 of the support member 33 can be tilted with respect to the reference plane 23 by sliding the bearing surface 36 within the bearing surface 44 to pivot the contoured support member 33. Also, the support member 33 can be rotated about the longitudinal axis 39. The concave bearing surface 44 and the convex bearing surface 36 are dimensioned and positioned so that the pivoting of the support member 33 occurs about a point 46 which is located in the reference plane 23 and which lies on the longitudinal axis 39 of the support member 33. The maximum tilt angle $\theta$, preferably approximately 3.8°, of the longitudinal axis 39 is limited by the distance by which the convex bearing surface 36 extends beyond the upper surface of the upper bearing plate 42. Thus the pivoting action is limited by the pivot limiting juncture 38 contacting the upper surface of the bearing plate 42.

As shown in FIG. 3, the support member 33 contains a slot 48 and the upper and lower bearing plates 42 and 41 respectively include a slot 49. The envelopes 16, therefore, can be inserted into and removed from the support member 33 with the minimum vertical movement of the envelopes.

The internal contour 34 of the support member 33 engages the major portion of the contour neck area 19 of the envelope and thus references the envelope to the contour area rather than to a particular cross-sectional diameter of the envelope. This manner of reference greatly enhances the precision with which the envelopes are vertically positioned in the fixture. After the envelopes are inserted into the support member 33, the necks of the envelopes are engaged by clamping members to insure that the longitudinal axis 39 of the support member 33 is parallel to the longitudinal axes of the support rods 11 and 12. The ability of the support member 33 to pivot about the point 46 permits the accurate longitudinal alignment of envelopes while minimizing the number of necks which are broken off of envelopes while simultaneously accurately maintaining the preselected sealing length which is established between the reference plane 23 and the sealing plane 26.

Television CRT's are classified according to several characteristics; two of which the diagonal of the viewing area and the total angle through which the electron beams are deflected. For example, a 25 V tube has a 25 inch (63.5 cm) diagonal, and in a 100° tube the electron beams are deflected 50° on each side of the longitudinal axis of the tube neck. The deflection angle determines the contour of the contoured neck area 19, and is independent of the screen size. Accordingly, the support 33 can be used for all envelopes of a particular deflection angle irrespective of the size of the screen.

What is claimed is:

1. Apparatus for accurately establishing a preselected sealing length between a sealing plane and reference plane within a contoured neck area of a funnel-shaped envelope comprising:

a support member having an internal contour configured to conform with and extending coextensive with said contoured neck area whereby said internal contour engages a major portion of said contoured neck area, said support member having an external convex bearing surface in the proximity of said neck area;

base means defining said reference plane spaced said preselected sealing length from said sealing plane, said base means including a concave bearing surface in the proximity of said reference plane, said concave and convex bearing surfaces being configured whereby said bearing surfaces contiguously engage to pivotably retain said support member said preselected sealing length from said sealing plane.

2. The apparatus of claim 1 wherein said base means includes an upper bearing plate and a lower bearing plate, said bearing plates being arranged in a contiguous parallel relationship whereby said reference plane is defined by the contiguous surfaces of said plates.

3. The apparatus of claim 2 wherein said concave bearing surface is formed in said upper and lower bearing plates whereby said support member pivots about a point in said reference plane.

4. The apparatus of claim 3 wherein the outside surface of said support member flares outwardly from said convex bearing surface around a pivot limiting juncture, and wherein said convex bearing surface extends beyond said upper bearing plate whereby said juncture and said upper plate limits said pivoting to a preselected value.

* * * * *